US009626888B2

(12) United States Patent
Wang et al.

(10) Patent No.: US 9,626,888 B2
(45) Date of Patent: Apr. 18, 2017

(54) METHOD AND APPARATUS FOR TESTING DISPLAY PANEL

(71) Applicant: SHENZHEN CHINA STAR OPTOELECTRONICS TECHNOLOGY CO., LTD, Shenzhen (CN)

(72) Inventors: Zhenling Wang, Shenzhen (CN); Tai-Jiun Hwang, Shenzhen (CN)

(73) Assignee: SHENZHEN CHINA STAR OPTOELECTRONICS TECHNOLOGY CO., LTD, Guangdong (CN)

( * ) Notice: Subject to any disclaimer, the term of this patent is extended or adjusted under 35 U.S.C. 154(b) by 373 days.

(21) Appl. No.: 14/404,640

(22) PCT Filed: Sep. 12, 2014

(86) PCT No.: PCT/CN2014/086373

§ 371 (c)(1),
(2) Date: Dec. 1, 2014

(87) PCT Pub. No.: WO2016/037347

PCT Pub. Date: Mar. 17, 2016

(65) Prior Publication Data

US 2016/0069947 A1 Mar. 10, 2016

(30) Foreign Application Priority Data

Sep. 10, 2014 (CN) ..... 2014 1 0459271

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01); *G09G 2320/0257* (2013.01)

(58) Field of Classification Search
USPC ..... 324/760.01, 760.02, 762.07
See application file for complete search history.

(56) References Cited

U.S. PATENT DOCUMENTS

| | | | | |
|---|---|---|---|---|
| 7,411,410 | B2 * | 8/2008 | Kang | G02F 1/1309 324/756.07 |
| 2009/0256493 | A1 * | 10/2009 | Tonomura | G09G 3/006 315/291 |
| 2015/0325188 | A1 | 11/2015 | Wei et al. | |

FOREIGN PATENT DOCUMENTS

| | | | |
|---|---|---|---|
| CN | 1959482 | A | 5/2007 |
| CN | 103345898 | A | 10/2013 |
| CN | 103943064 | A | 7/2014 |
| CN | 103995407 | A | 8/2014 |
| JP | 2003060922 | A | 6/2003 |

* cited by examiner

*Primary Examiner* — Vincent Q Nguyen
*Assistant Examiner* — Alvaro Fortich
(74) *Attorney, Agent, or Firm* — Mark M. Friedman

(57) ABSTRACT

A method and an apparatus for testing a display panel are provided. The apparatus comprises an interface circuit for connecting to the display panel to be tested, and a test circuit for generating a test signal to the display panel through the interface circuit in a test state for a display panel, and for generating an adjustment signal to the display panel through the interface circuit in a predetermined state for the display panel, wherein at least a portion of an afterimage signal in the display panel is reduced by the adjustment signal.

20 Claims, 7 Drawing Sheets

METHOD AND APPARATUS FOR TESTING DISPLAY PANEL

FIELD OF THE INVENTION

The present invention relates to a technical field of testing a display panel, and in particular to a method and an apparatus for testing a display panel.

BACKGROUND OF THE INVENTION

The traditional technical solution for testing a display panel is as follows:

A test signal is provided to the display panel. The display panel receives the test signal and displays the test signal.

However, the display panel must be turned on/off during the test process.

In practice, the inventor has found some problems in the prior art.

The display panel shows an afterimage signal when the display panel is turned on, and the afterimage signal remains when the display panel is turned off.

In addition, during the test process of an AMOLED (Active Matrix Organic Light Emitting Diode), the driving switch circuit of the AMOLED is easily oxidized, so that the switch voltage threshold (Vth) has an offset.

As a result, it is necessary to provide a display panel and driving method therefor to solve the problems existing in the conventional technologies, as described above.

The inventor has therefore developed a method and an apparatus for testing a display panel to solve the problems existing in the conventional art, as described above.

SUMMARY OF THE INVENTION

A primary object of the present invention is to provide a method and an apparatus for testing a display panel which reduces an afterimage signal when the display panel is turned on.

To achieve the above objects, the present invention provides an apparatus for testing a display panel which comprises an interface circuit for connecting to the display panel to be tested; and an interface circuit for connecting to the display panel to be tested; wherein the test circuit comprises a test signal generation circuit for generating the test signal; an adjustment signal generation circuit for generating the adjustment signal; and a selection circuit for receiving the test signal and the adjustment signal and for outputting the test signal in the test state for the display panel and for outputting the adjustment signal in the predetermined state for the display panel, wherein the predetermined state is a state when the display panel is turned off or within a second predetermined time after turning off the display panel, and the second predetermined time is in a range of 0.01 seconds to 5 seconds.

In one embodiment of the present invention, the selection circuit comprises a first switch, a second switch, and a control circuit, wherein the first switch comprises a first input terminal for receiving the test signal; a first output terminal for outputting the test signal when a first current channel is opened between the first input terminal and the first output terminal; and a first control terminal for receiving a first control signal, wherein the first current channel is opened/closed according to the first control signal; the second switch comprises a second input terminal for receiving the adjustment signal; a second output terminal for outputting the adjustment signal when a second current channel was opened between the second input terminal and the second output terminal; and a second control terminal for receiving a second control signal, wherein the second current channel is opened/closed according to the second control signal; the control circuit is connected to the first control terminal and the second control terminal for generating the first control signal and the second control signal.

In one embodiment of the present invention, the first control terminal opens the first current channel according to the first control signal in the test state for the display panel, and the second control terminal closes the second current channel according to the second control signal in the test state for the display panel; the first control terminal closes the first current channel according to the first control signal in the predetermined state for the display panel, and the second control terminal opens the second current channel according to the second control signal in the predetermined state for the display panel.

To achieve the above objects, the present invention provides an apparatus for testing a display panel which comprises an interface circuit for connecting to the display panel to be tested; and a test circuit connected to the interface circuit for generating a test signal to the display panel through the interface circuit in a test state for the display panel, and for generating an adjustment signal to the display panel through the interface circuit in a predetermined state for the display panel, wherein at least a portion of an afterimage signal in the display panel is reduced by the adjustment signal in the predetermined state for the display panel.

In one embodiment of the present invention, the predetermined state is a state when the display panel is turned on for a first predetermined time after turning on the display panel.

In one embodiment of the present invention, the test circuit and the interface circuit control the adjustment signal to the display panel before the display panel receives a turning on signal when the display panel is turned on.

In one embodiment of the present invention, the predetermined state is a state when the display panel is turned off or a second predetermined time after turning off the display panel.

In one embodiment of the present invention, the test circuit comprises a test signal generation circuit for generating the test signal; an adjustment signal generation circuit for generating the adjustment signal; and a selection circuit for receiving the test signal and the adjustment signal, and for outputting the test signal in the test state for the display panel, and for outputting the adjustment signal in the predetermined state for the display panel.

In one embodiment of the present invention, the selection circuit comprises a first switch, a second switch, and a control circuit, wherein the first switch comprises a first input terminal for receiving the test signal; a first output terminal for outputting the test signal when a first current channel is opened between the first input terminal and the first output terminal; and a first control terminal for receiving a first control signal, wherein the first current channel is opened/closed according to the first control signal; the second switch comprises a second input terminal for receiving the adjustment signal; a second output terminal for outputting the adjustment signal when a second current channel is opened between the second input terminal and the second output terminal; and a second control terminal for receiving a second control signal, wherein the second current channel is opened/closed according to the second control signal; and the control circuit is connected to the first control terminal and the second control terminal for generating the first control signal and the second control signal.

In one embodiment of the present invention, the first control terminal opens the first current channel according to the first control signal in the test state for the display panel, and the second control terminal closes the second current channel according to the second control signal in the test state for the display panel; the first control terminal closes the first current channel according to the first control signal in the predetermined state for the display panel, and the second control terminal opens the second current channel according to the second control signal in the predetermined state for the display panel.

In one embodiment of the present invention, the adjustment signal comprises at least one turning on signal for turning on a thin film transistor switch of the display panel; and at least one reducing signal inputted in the pixel electrodes of the display panel to reduce the afterimage signal in the display panel when the thin film transistor switch is turned on.

In one embodiment of the present invention, the turning on signal is a high level signal, and the reducing signal is a low level signal; the turning on signal is inputted to a gate of the thin film transistor switch through a scan line of the display panel by the test circuit, and the afterimage signal is inputted to the pixel electrodes through a data line of the display panel and the thin film transistor switch by the test circuit.

In one embodiment of the present invention, at least a portion of an electric charge of the pixel electrode is reduced or canceled in the display panel by the reducing signal, and the electric field of the pixel electrode is restored to an initial state in the display panel.

In one embodiment of the present invention, the display panel is an active matrix OLED panel, the test circuit sends an inhibitory signal to the active matrix OLED panel in a predetermined state, and the inhibitory signal is provide to a driving switch circuit to inhibit the offset of the voltage threshold of the driving switch circuit.

In one embodiment of the present invention, the active matrix OLED panel comprises the driving switch circuit for receiving a turning on signal and a turning off signal, the driving switch circuit comprises a transistor having a third control terminal, a first end for receiving the turning on signal, and a second end for receiving the turning off signal, the third control terminal and the first end are connected to two plates of a capacitor respectively, and the second end is connected to a diode; the inhibitory signal is a positive voltage signal and is provided to an end of the diode connected to the second end of the transistor, and the voltage of the third control terminal is higher than the voltage of the second end by positive voltage signal to inhibit the offset of the voltage threshold.

To achieve the above objects, the present invention provides a method for testing a display panel which comprises steps of generating a test signal to the display panel through an interface circuit in a test state for the display panel by a test circuit; and generating an adjustment signal to the display panel through the interface circuit in a predetermined state for the display panel to reduce at least a portion of the afterimage signal in the display panel.

In one embodiment of the present invention, the method comprising the steps of generating a test signal by a test signal generation circuit in the test state for the display panel, and receiving the test signal by a selection circuit, and outputting the test signal; generating an adjustment signal by an adjustment signal generation circuit in the predetermined state for the display panel, receiving the adjustment signal by the selection circuit, and outputting the adjustment signal.

In one embodiment of the present invention, the method comprising the steps of generating a first control signal and a second control signal by a control circuit; receiving the first control signal by a first control terminal of a first switch in the test state for the display panel, and opening a first current channel according to the first control signal, and outputting the test signal by the first output terminal of the first switch, and receiving the second control signal by a second control terminal of a second switch, and closing a second current channel according to the second control signal; and receiving the first control signal by the first control terminal in the predetermined state for the display panel, and closing the first current channel according to the first control signal, and receiving the second control signal by the second control terminal, and opening the second current channel according to the second control signal, and outputting the adjustment signal by the second output terminal, wherein the first current channel is positioned between the first input terminal and the first output terminal, and the second current channel is positioned between the second input terminal and the second output terminal.

In one embodiment of the present invention, the adjustment signal comprises at least one turning on signal for turning on a thin film transistor switch of the display panel; and at least one reducing signal inputted in the pixel electrodes of the display panel to reduce the afterimage signal in the display panel when the thin film transistor switch is turned on; the method further comprising the steps of inputting the turning on signal to a gate of the thin film transistor switch through a scan line of the display panel by the test circuit, and inputting the reducing signal to the pixel electrodes through a data line of the display panel and the thin film transistor switch by the test circuit.

In one embodiment of the present invention, the display panel is an active matrix OLED panel, and the method further comprising the steps of sending an inhibitory signal by the test circuit to the active matrix OLED panel in the predetermined state, and the inhibitory signal is provide to a driving switch circuit to inhibit the offset of the voltage threshold of the driving switch circuit.

Compared to the prior art, the apparatus of the present invention can reduce the afterimage signal when the display panel is turned on.

The above-mentioned content of the present invention can be best understood by referring to the following detailed description of the preferred embodiments and the accompanying drawings.

DETAILED DESCRIPTION OF THE PREFERRED EMBODIMENTS

The following description of embodiments with reference to the attached drawings is to be used to illustrate particular embodiments of the present invention.

Figure 1:
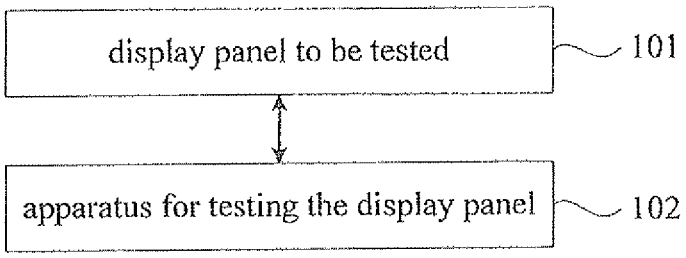
FIG. 1 is a block diagram of an apparatus of the present invention for testing a display panel.
Figure 2:
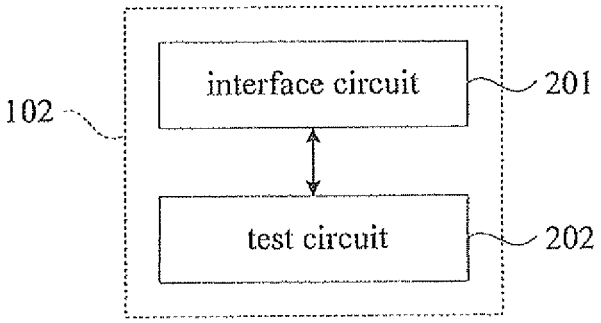
FIG. 2 is a block diagram of the apparatus according to FIG. 1.
Figure 5:
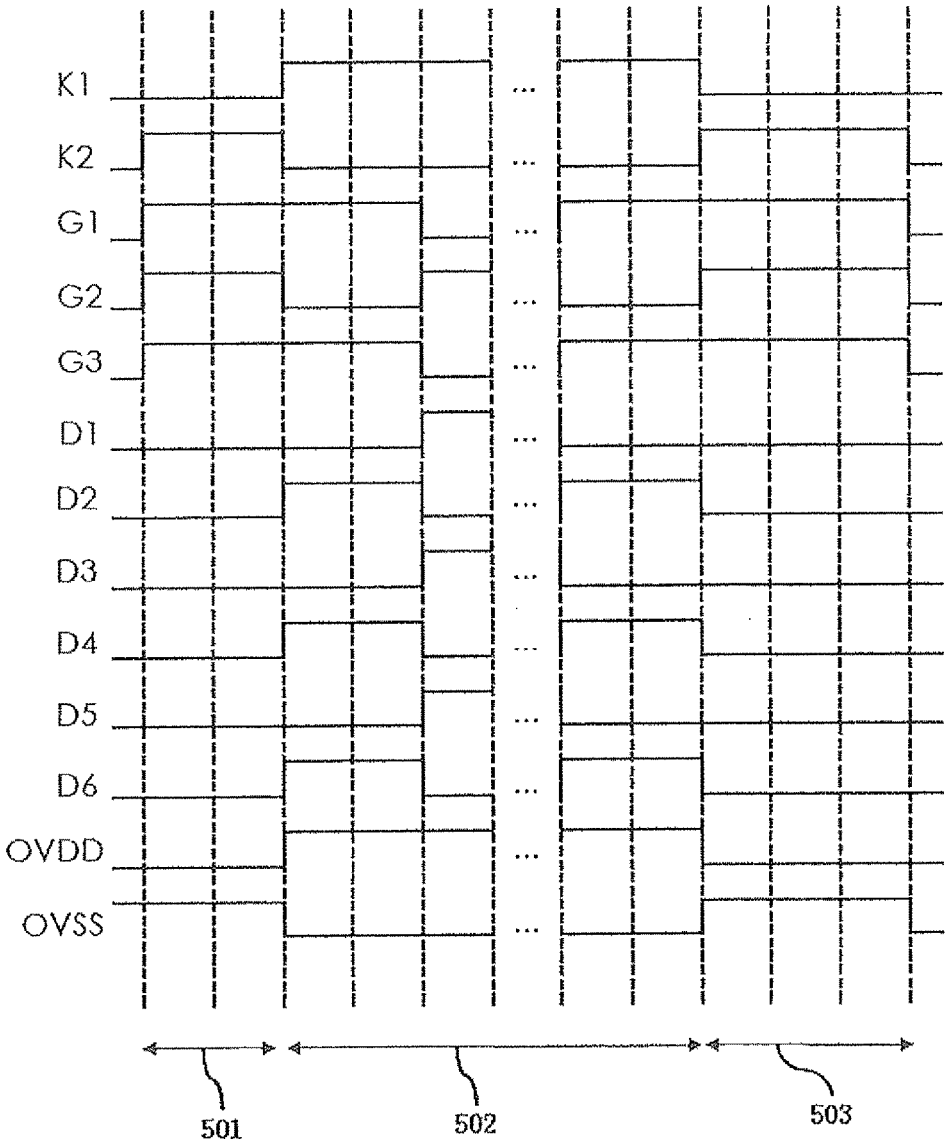
FIG. 5 is an operational view of the display panel in a different state according to FIG. 1.

Referring to FIGS. 1, 2, and 5, FIG. 1 is a block diagram of an apparatus 102 of the present invention for testing a display panel 101. FIG. 2 is a block diagram of the apparatus 102 in FIG. 1. FIG. 5 is an operational view of the display panel in a different state according to FIG. 1.

The display panel 102 of the present invention, such as an LCD (Liquid Crystal Display) or an AMOLED (Active Matrix Organic Light Emitting Diode), comprises an interface circuit 201 and a test circuit 202. The display panel 102 is connected to the display panel 101 to be tested through the interface circuit 201. The display panel 102 further comprises a machine for loading the display panel 101, so that the display panel 101 is tested by an operator.

The interface circuit 201 is disposed on the machine for connecting to the display panel 101. The interface circuit 201 comprises at least one interface for connecting to a signal interface (such as pad) of the display panel 101. The test circuit 202 is connected to the interface circuit 201 for generating a test signal 502 in a test state for the display panel (such as displaying a test state) to provide the test signal 502 through the interface circuit 201, and for generating an adjustment signal in a predetermined state (501, 503) for the display panel to provide the adjustment signal to the display panel through the interface circuit 201.

The predetermined state (501, 503) is a state when the display panel is turned on and/or turned off. The predetermined state 501 is a state when the display panel 101 is turned on or a first predetermined time after turning on the display panel 101, and the predetermined state 503 is a state when the display panel 101 is turned off or a second predetermined time after turning off the display panel 101. The first and second predetermined time are in a range of 0.01 seconds to 5 seconds, such as 0.02 seconds, 0.035 seconds, 0.05 seconds, 0.08 seconds, 0.09 seconds, 1.12 seconds, 1.2 seconds, 1.25 seconds, 1.38 seconds, 1.45 seconds, 1.56 seconds, 1.69 seconds, 1.72 seconds, 1.85 seconds, 1.99 seconds, 2.03 seconds, 2.13 seconds, 2.3 seconds, 2.41 seconds, 2.55 seconds, 2.64 seconds, 2.73 seconds, 2.89 seconds, 2.96 seconds, 3.1 seconds, 3.3 seconds, 3.35 seconds, 3.51 seconds, 3.6 seconds, 3.73 seconds, 3.87 seconds, 3.95 seconds, 4.03 seconds, 4.2 seconds, 4.29 seconds, 4.36 seconds, 4.51 seconds, 4.62 seconds, 4.78 seconds, 4.89 seconds, 4.96 seconds, 5 seconds; the first and second predetermined time are equal or unequal.

In the predetermined state 501, the test circuit 202 and the interface circuit 201 control the adjustment signal to the display panel before the display panel receives a turning on signal (such as a signal OVDD in FIG. 5) when the display panel 101 is turned on, and the test circuit 202 and the interface circuit 201 reduce the afterimage signal of the display panel 101 before turning on the display panel 101 by the adjustment signal.

When the display panel 101 is in the predetermined state, the adjustment signal is proven to reduce at least one afterimage signal of the display panel 101. The afterimage signal is a remaining signal after turning off the display panel. The afterimage signal corresponds to the remaining electric charge of the pixel electrode (or LCD capacitive) of the display panel 101.

For example, when the display panel 101 is in the predetermined state 503, the test circuit 202 provides the adjustment signal to the display panel through the interface circuit 201, so that the afterimage signal of the display panel 101 is reduced, and the afterimage signal can be avoided when the display panel 101 is turned on again.

Figure 3:
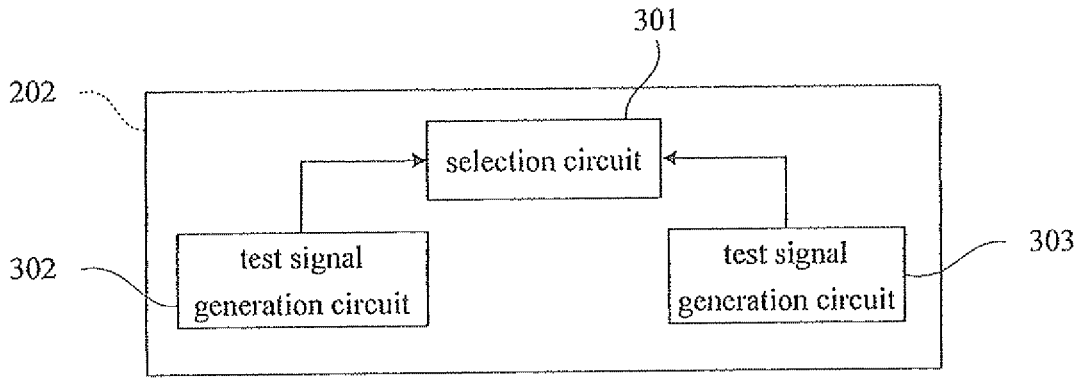
FIG. 3 is a block diagram of a test circuit according to FIG. 2.

FIG. 3 is a block diagram of a test circuit in FIG. 2. In the present embodiment, the test circuit 202 comprises a test signal generation circuit 302 for generating a test signal, an adjustment signal generation circuit 303 for generating an adjustment signal, and a selection circuit 301 for receiving the test signal and the adjustment signal, and for outputting the test signal in the test state for the display panel 101, and for outputting the adjustment signal in the predetermined state for the display panel. Specifically, when the display panel 101 is in the test state 502, the selection circuit 301 outputs the test signal to the display panel 101 through the interface circuit 201. When the display panel 101 is in the predetermined state, the selection circuit 301 outputs the adjustment signal to the display panel 101 through the interface circuit 201.

Figure 4:
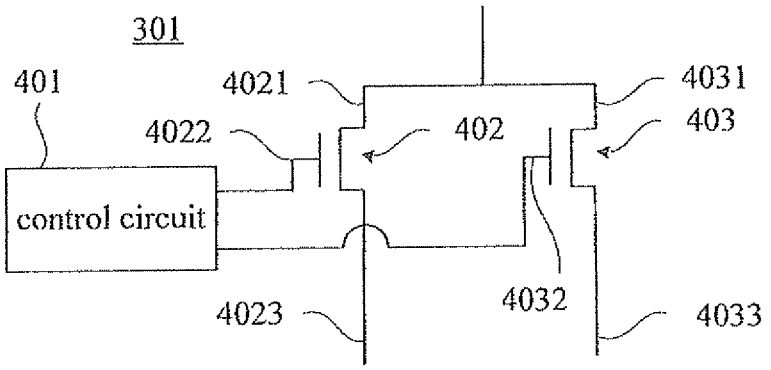
FIG. 4 is a block diagram of a selection circuit according to FIG. 3.

FIG. 4 is a block diagram of a selection circuit 301 in FIG. 3. In the present embodiment, the selection circuit 301 comprises a first switch 402, a second switch 403 and a control circuit 401. The first switch 402, the second switch 403, and the control circuit 401 are transistors. The first switch 402 comprises a first input terminal 4023 for receiving the test signal, and a first output terminal 4021 for outputting the test signal when a first current channel is opened between the first input terminal 4023 and the first output terminal 4021, and a first control terminal 4022 for receiving a first control signal K1. The first current channel is opened/closed according the first control signal K1.

The second switch 403 comprises a second input terminal 4033 for receiving the adjustment signal, and a second output terminal 4031 for outputting the adjustment signal when a second current channel was opened between the second input terminal 4033 and the second output terminal 4031, and a second control terminal 4032 for receiving a second control signal K2. The second current channel was opened/closed according to the second control signal K2.

The control circuit 401 is connected to the first control terminal 4022 and the second control terminal 4032 for generating the first control signal K1 and the second control signal K2.

In the present embodiment, when the display panel 101 is in the test state 502, the first control terminal 4022 controls the first current channel opened according to the first control signal K1, and the second control terminal 4032 controls the second current channel closed according to the second control signal K2. When the display panel 101 is in the predetermined state, the first control terminal 4022 controls the first current channel closed according to the first control signal K1, and the second control terminal 4032 controls the second current channel opened according to the second control signal K2. For example, the first control signal K1 is a low level signal to turn off the first current channel, and the first control signal K1 is a high level signal to turn on the first current channel, and the second control signal K2 is a low level signal to close the second current channel, and the second control signal K2 is a high level signal to open the second current channel.

In the present embodiment, the adjustment signal comprises at least one turning on signal (such as G1, G2, and G3 in FIG. 5) for turning on a thin film transistor switch of the display panel 101, and at least one reducing signal (such as D1, D2, D3, D4, D5, and D6 in FIG. 5) inputted in the pixel electrodes of the display panel to reduce the afterimage signal in the display panel when the thin film transistor switch is turned on. At least a portion of an electric charge of the pixel electrode is reduced or canceled in the display panel by the reducing signal, and the electric field of the pixel electrode is restored to an initial state in the display panel.

In the present embodiment, the turning on signal is a high level signal, and the reducing signal is a low level signal. For example, when the display panel is in the predetermined state (501, 503), the turning on signals (G1, G2, G3) are high level signals in FIG. 5. When the display panel is in the predetermined state (501, 503), the reducing signals (D1, D2, D3, D4, D5, D6) are low level signals.

The turning on signal is inputted to a gate of the thin film transistor switch through a scan line of the display panel 101 by the test circuit 202, and the reducing signal is inputted to the pixel electrodes through a data line of the display panel and the thin film transistor switch by the test circuit 202.

As stated above, the electric charge of the pixel electrode can be reduced after testing the display panel, and the electric field of the pixel electrode can be restored to an initial state in the display panel, so that the afterimage signal can be avoided when the display panel 101 is turned on again.

When the display panel is an active matrix OLED panel, the active matrix OLED panel comprises a driving switch circuit for receiving a turning on signal (OVDD) and a turning off signal (OVSS). The driving switch circuit comprises a transistor, and the transistor has a third control terminal, a first end for receiving the turning on signal, and a second end for receiving the turning off signal. The third control terminal and the first end are connected to two plates of a capacitor respectively, and the second end is connected to a diode. The test circuit further sends an inhibitory signal to the active matrix OLED panel in the predetermined state, and the inhibitory signal is provided to a driving switch circuit to inhibit an offset of the voltage threshold of the driving switch circuit.

The inhibitory signal is a positive voltage signal and provide to an end of the diode connected to the second end of the transistor, and the voltage of the third control terminal is higher than the voltage of the second end by positive voltage signal to inhibit the offset of the voltage threshold. The life of the active matrix OLED panel can be increased.

Figure 6:
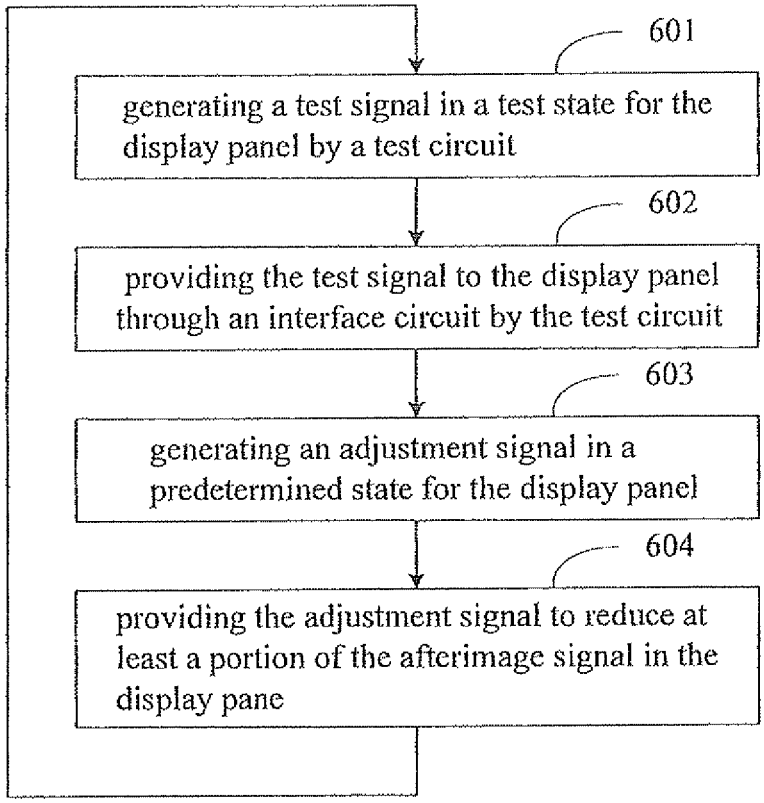
FIG. 6 is a flowchart of a method of the present invention for testing a display panel.

FIG. 6 is a flowchart of a method of the present invention for testing a display panel. The present invention provides a method for testing a display panel which comprises steps of:

In a step 601, a test circuit 202 generates a test signal when the display panel 101 in a test state 502.

In a step 602, the test circuit 202 provides the test signal to the display panel through an interface circuit 201.

In a step 603, the test circuit 202 generates an adjustment signal when the display panel 101 in a predetermined state.

In a step 604, the test circuit 202 provides the adjustment signal to the display panel 101 through an interface circuit 201 to reduce at least a portion of the afterimage signal in the display panel.

Step 601, step 602, step 603, and step 604 are not in any particular order. Step 601 and step 602 can be executed before step 603 and step 604, or step 603 and step 604 can be executed before step 601 and step 602. Step 601, step 602, step 603, and step 604 can be executed at the same time.

The predetermined state is a state when the display panel is turned on and/or turned off. The predetermined state 501 is a state when the display panel 101 is turned on for a first predetermined time after turning on the display panel 101, and the predetermined state 503 is a state when the display panel 101 is turned off for a second predetermined time after turning off the display panel 101. The first and second predetermined time are in a range of 0.01 seconds to 5 seconds, such as 0.02 seconds, 0.035 seconds, 0.05 seconds, 0.08 seconds, 0.09 seconds, 1.12 seconds, 1.2 seconds, 1.25 seconds, 1.38 seconds, 1.45 seconds, 1.56 seconds, 1.69 seconds, 1.72 seconds, 1.85 seconds, 1.99 seconds, 2.03 seconds, 2.13 seconds, 2.3 seconds, 2.41 seconds, 2.55 seconds, 2.64 seconds, 2.73 seconds, 2.89 seconds, 2.96 seconds, 3.1 seconds, 3.3 seconds, 3.35 seconds, 3.51 seconds, 3.6 seconds, 3.73 seconds, 3.87 seconds, 3.95 seconds, 4.03 seconds, 4.2 seconds, 4.29 seconds, 4.36 seconds, 4.51 seconds, 4.62 seconds, 4.78 seconds, 4.89 seconds, 4.96 seconds, 5 seconds; the first and second predetermined time are equal or unequal.

In the predetermined state 501, the test circuit 202 and the interface circuit 201 control the adjustment signal to the display panel before the display panel receives a turning on signal (such as a signal OVDD in FIG. 5) when the display panel 101 is turned on, and the test circuit 202 and the interface circuit 201 reduce the afterimage signal of the display panel 101 before turning on the display panel 101 by the adjustment signal.

When the display panel 101 is in the predetermined state, the adjustment signal is proven to reduce at least one afterimage signal of the display panel 101. The afterimage signal is a remaining signal after turning off the display panel. The afterimage signal corresponds to the remaining electric charge of the pixel electrode (or LCD capacitive) of the display panel 101.

For example, when the display panel 101 is in the predetermined state 503, the test circuit 202 provides the adjustment signal to the display panel through the interface circuit 201, so that the afterimage signal of the display panel 101 is reduced, and the afterimage signal can be avoided when the display panel 101 is turned on again.

Figure 7:
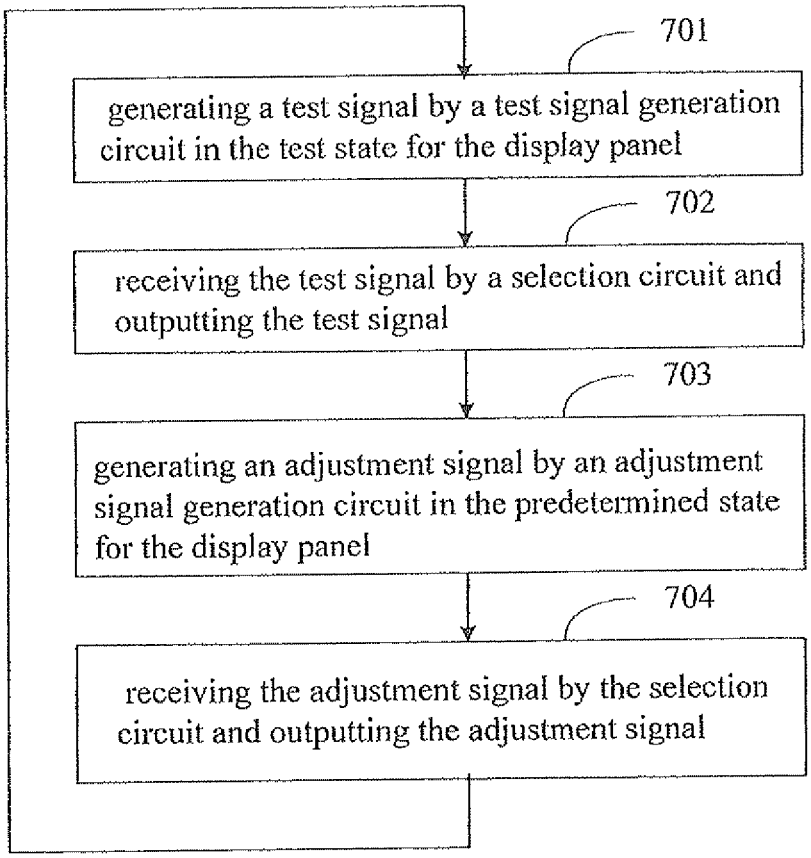
FIG. 7 is a flowchart of an operational the test circuit according to FIG. 6.

FIG. 7 is a flowchart of the test circuit according to FIG. 6. The method of the present invention further comprises steps of:

In a step 701, a test signal generation circuit 302 generates a test signal when the display panel is in the test state 502.

In a step 702, a selection circuit 301 receives the test signal and outputs the test signal.

In a step 703, an adjustment signal generation circuit 303 generates an adjustment signal when the display panel is in a predetermined state.

In a step 704, selection circuit 301 receives the adjustment signal and outputs the adjustment signal.

Step 701, step 702, step 703, and step 704 are not in any particular order. Step 701 and step 702 can be executed before step 703 and step 704, or step 703 and step 704 can be executed before step 701 and step 702. Step 701, step 702, step 703, and step 704 can be executed at the same time.

When the display panel 101 is in the test state 502, the selection circuit 301 outputs the test signal to the display panel 101 through the interface circuit 201. When the display panel 101 is in the predetermined state, the selection circuit 301 outputs the adjustment signal to the display panel 101 through the interface circuit 201.

Figure 8:
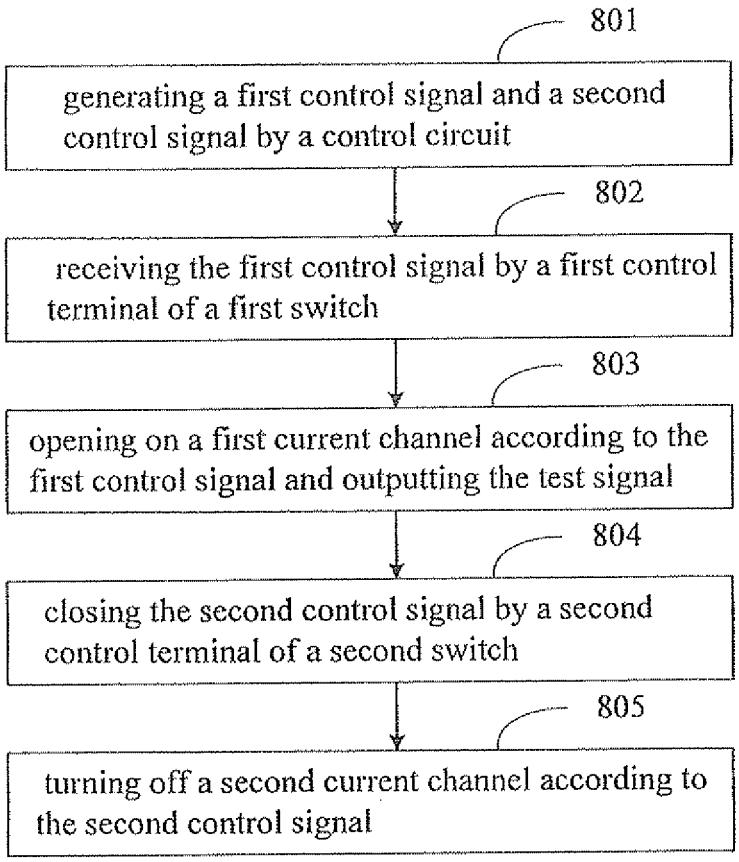
FIG. 8 is a flowchart of the test circuit when the display panel is tested in a test state according to FIG. 7.

FIG. 8 is a flowchart of an operational the test circuit when the display panel 101 is tested in a test state according to FIG. 7. In the present embodiment, when the display panel 101 is in the test state 502, the method of the present invention further comprises steps of:

In a step 801, a control circuit 401 generates a first control signal K1 and a second control signal K2.

In a step 802, a first control terminal 4022 of a first switch 402 receives the first control signal K1.

In a step 803, the first control terminal 4022 opens a first current channel according to the first control signal K1, so that a first output terminal 4021 of the first switch 402 outputs the test signal.

In a step 804, a second control terminal 4032 of a second switch 403 receives the second control signal K2.

In a step 805, the second control signal 4032 closes a second current channel according to the second control signal K2.

Step 802, step 803, step 804, and step 805 are not in any particular order. Step 802 and step 803 can be executed before step 804 and step 805, or step 804 and step 805 can be executed before step 802 and step 803. Step 802, step 803, step 804, and step 805 can be executed at the same time.

For example, the first control signal K1 is a low level signal to close the first current channel, and the first control signal K1 is a high level signal to open the first current channel, and the second control signal K2 is a low level signal to close the second current channel, and the second control signal K2 is a high level signal to open the second current channel.

Figure 9:
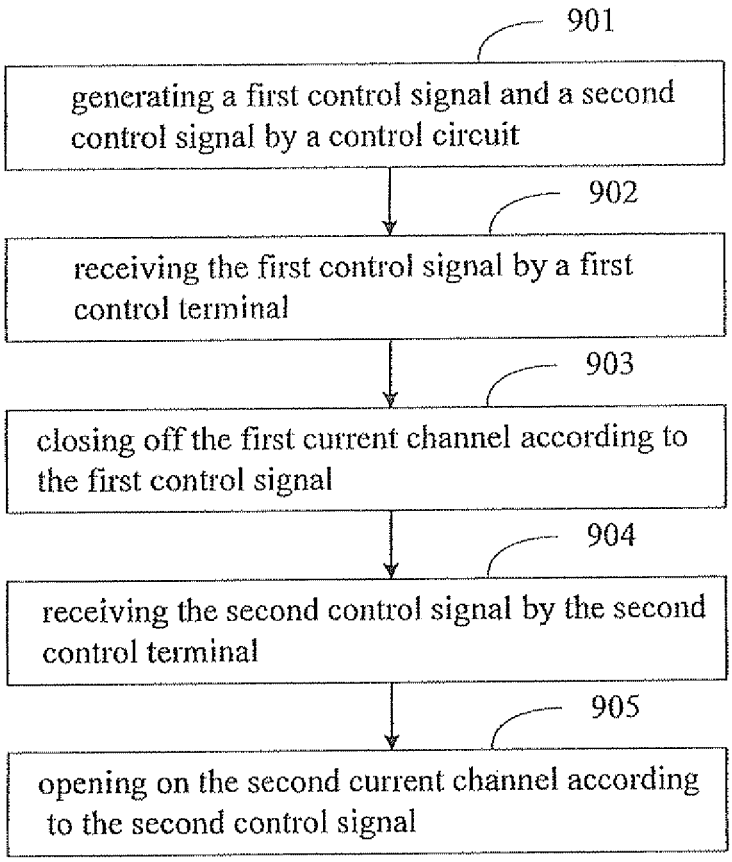
FIG. 9 is a flowchart of an operational the test circuit when the display panel is tested in a predetermined state according to FIG. 7.

FIG. 9 is a flowchart of the test circuit when the display panel is tested in a predetermined state according to FIG. 7. In the present embodiment, when the display panel 101 is in the predetermined state, the method of the present invention further comprises steps of:

In a step 901, a control circuit 401 generates a first control signal K1 and a second control signal K2.

In a step 902, a first control terminal 4022 receives the first control signal K1.

In a step 903, the first control terminal 4022 closes a first current channel according to the first control signal K1.

In a step 904, a second control terminal 4032 receives the second control signal K2.

In a step 905, the second control signal 4032 opens a second current channel according to the second control signal K2, so that a second output terminal 4031 outputs the adjustment signal.

Step 902, step 903, step 904, and step 905 are not in any particular order. Step 902 and step 903 can be executed before step 904 and step 905, or step 904 and step 905 can be executed before step 902 and step 903. Step 902, step 903, step 904, and step 905 can be executed at the same time.

The first current channel is a current channel between the first input terminal 4023 and the first output terminal 4021, and the second current channel is a current channel between the second input terminal 4033 and the second output terminal 4031.

In the present embodiment, the adjustment signal comprises at least one turning on signal for turning on a thin film transistor switch of the display panel 101, and at least one reducing signal inputted in the pixel electrodes of the display panel to reduce the afterimage signal in the display panel when the thin film transistor switch is turned on. At least a portion of an electric charge of the pixel electrode is reduced or canceled in the display panel by the reducing signal, and the electric field of the pixel electrode is restored to an initial state in the display panel.

Referring to FIG. 5, when the display panel is in the predetermined state (501, 503), and the turning on signals (G1, G2, G3) are high level signals. When the display panel is in the predetermined state (501, 503), and the reducing signals (D1, D2, D3, D4, D5, D6) are low level signals.

The method further comprises steps of:

The turning on signal is inputted to a gate of the thin film transistor switch through a scan line of the display panel 101 by the test circuit 202, and the reducing signal is inputted to the pixel electrodes through a data line of the display panel and the thin film transistor switch by the test circuit 202.

As stated above, the electric charge of the pixel electrode can be reduced after testing the display panel, and the electric field of the pixel electrode can be restored to an initial state in the display panel, so that the afterimage signal can be avoided when the display panel 101 is turned on again.

When the display panel is an active matrix OLED panel, the active matrix OLED panel comprises a driving switch circuit for receiving a turning on signal (OVDD) and a turning off signal (DVSS). The driving switch circuit comprises a transistor, and the transistor has a third control terminal, a first end for receiving the turning on signal, and a second end for receiving the turning off signal. The third control terminal and the first end are connected to two plates of a capacitor respectively, and the second end is connected to a diode. The method further comprises steps of:

The test circuit further sends an inhibitory signal to the active matrix OLED panel in the predetermined state, and the inhibitory signal is provided to a driving switch circuit to inhibit an offset of the voltage threshold of the driving switch circuit.

The inhibitory signal is a positive voltage signal and provided to an end of the diode connected to the second end of the transistor, and the voltage of the third control terminal is higher than the voltage of the second end by positive voltage signal to inhibit the offset of the voltage threshold. The life of the active matrix OLED panel can be increased.

The present invention has been described with a preferred embodiment thereof and it is understood that many changes and modifications to the described embodiment can be carried out without departing from the scope and the spirit of the invention that is intended to be limited only by the appended claims.

What is claimed is:

1. An apparatus for testing a display panel, comprising:

an interface circuit for connecting to the display panel to be tested; and a test circuit connected to the interface circuit for generating a test signal to the display panel through the interface circuit in a test state for the display panel, and for generating an adjustment signal to the display panel through the interface circuit in a predetermined state for the display panel, wherein at least a portion of an afterimage signal in the display panel is reduced by the adjustment signal in the predetermined state for the display panel;

wherein the test circuit comprises:

a test signal generation circuit for generating the test signal;

an adjustment signal generation circuit for generating the adjustment signal; and a selection circuit for receiving the test signal and the adjustment signal and for outputting the test signal in the test state for the display panel and for outputting the adjustment signal in the predetermined state for the display panel, wherein the predetermined state is a state when the display panel is turned off or within a second predetermined time after turning off the display panel, and the second predetermined time is in a range of 0.01 seconds to 5 seconds.

2. The apparatus for testing the display panel according to claim 1, wherein the selection circuit comprises a first switch, a second switch, and a control circuit, wherein the first switch comprises:

a first input terminal for receiving the test signal;

a first output terminal for outputting the test signal when a first current channel is opened between the first input terminal and the first output terminal; and a first control terminal for receiving a first control signal, wherein the first current channel is opened/closed by the first control signal;

the second switch comprises:

a second input terminal for receiving the adjustment signal;

a second output terminal for outputting the adjustment signal when a second current channel is opened between the second input terminal and the second output terminal; and a second control terminal for receiving a second control signal, wherein the second current channel is opened/closed by the second control signal;

the control circuit is connected to the first control terminal and the second control terminal for generating the first control signal and the second control signal.

3. The apparatus for testing the display panel according to claim 2, wherein the first control terminal controls the first current channel to be opened according to the first control signal in the test state for the display panel, and the second control terminal controls the second current channel to be closed according to the second control signal in the test state for the display panel;

the first control terminal closes the first current channel according to the first control signal in the predetermined state for the display panel, and the second control terminal opens the second current channel according to the second control signal in the predetermined state for the display panel.

4. An apparatus for testing a display panel, comprising:

an interface circuit for connecting to the display panel to be tested; and a test circuit connected to the interface circuit for generating a test signal to the display panel through the interface circuit in a test state for the display panel, and for generating an adjustment signal to the display panel through the interface circuit in a predetermined state for the display panel, wherein at least a portion of an afterimage signal in the display panel is reduced by the adjustment signal in the predetermined state for the display panel.

5. The apparatus for testing the display panel according to claim 4, wherein the predetermined state is a state when the display panel is turned on for a first predetermined time after turning on the display panel.

6. The apparatus for testing the display panel according to claim 5, wherein the test circuit and the interface circuit control the adjustment signal to the display panel before the display panel receiving a turning on signal when the display panel is turned on.

7. The apparatus for testing the display panel according to claim 4, wherein the predetermined state is a state when the display panel is turned off for a second predetermined time after turning off the display panel.

8. The apparatus for testing the display panel according to claim 4, wherein the test circuit comprises:

a test signal generation circuit for generating the test signal;

an adjustment signal generation circuit for generating the adjustment signal; and a selection circuit for receiving the test signal and the adjustment signal, and for outputting the test signal in the test state for the display panel, and for outputting the adjustment signal in the predetermined state for the display panel.

9. The apparatus for testing the display panel according to claim 8, wherein the selection circuit comprises a first switch, a second switch, and a control circuit, wherein the first switch comprises:

a first input terminal for receiving the test signal;

a first output terminal for outputting the test signal when a first current channel was opened between the first input terminal and the first output terminal; and a first control terminal for receiving a first control signal, wherein the first current channel is opened/closed by the first control signal;

the second switch comprises:

a second input terminal for receiving the adjustment signal;

a second output terminal for outputting the adjustment signal when a second current channel is opened between the second input terminal and the second output terminal; and a second control terminal for receiving a second control signal, wherein the second current channel is opened/closed by the second control signal;

the control circuit is connected to the first control terminal and the second control terminal for generating the first control signal and the second control signal.

10. The apparatus for testing the display panel according to claim 9, wherein the first control terminal opens the first current channel according to the first control signal in the test state for the display panel, and the second control terminal closes the second current channel according to the second control signal in the test state for the display panel;

the first control terminal closes the first current channel according to the first control signal in the predetermined state for the display panel, and the second control terminal opens the second current channel according to the second control signal in the predetermined state for the display panel.

11. The apparatus for testing the display panel according to claim 4, wherein the adjustment signal comprises:

at least one turning on signal for turning on a thin film transistor switch of the display panel; and at least one reducing signal inputted in the pixel electrodes of the display panel to reduce the afterimage signal in the display panel when the thin film transistor switch is turned on.

12. The apparatus for testing the display panel according to claim 11, wherein the turning on signal is a high level signal, and the reducing signal is a low level signal;

the turning on signal is inputted to a gate of the thin film transistor switch through a scan line of the display panel by the test circuit, and the reducing signal is inputted to the pixel electrodes through a data line of the display panel and the thin film transistor switch by the test circuit.

13. The apparatus for testing the display panel according to claim 12, wherein at least a portion of an electric charge of the pixel electrode is reduced or canceled in the display panel by the reducing signal, and the electric field of the pixel electrode is restored to an initial state in the display panel.

14. The apparatus for testing the display panel according to claim 4, wherein the display panel is an active matrix OLED panel, the test circuit sent an inhibitory signal to the active matrix OLED panel in a predetermined state, and the inhibitory signal is provide to a driving switch circuit to inhibit the offset of the voltage of the driving switch circuit.

15. The apparatus for testing the display panel according to claim 14, wherein the active matrix OLED panel comprises the driving switch circuit for receiving a turning on signal and a turning off signal, the driving switch circuit comprises a transistor having a third control terminal, a first end for receiving the turning on signal, and a second end for receiving the turning off signal, the third control terminal and the first end are connected to two plates of a capacitor respectively, and the second end is connected to a diode;

the inhibitory signal is a positive voltage signal and provided to an end of the diode connected to the second end of the transistor, and the voltage of the third control terminal is higher than the voltage of the second end by positive voltage signal to inhibit the offset of the voltage.

16. A method for testing a display panel, comprising steps of:

generating a test signal to the display panel through an interface circuit in a test state for the display panel by a test circuit; and generating an adjustment signal to the display panel through the interface circuit in a predetermined state for the display panel to reduce at least a portion of the afterimage signal in the display panel.

17. The method for testing the display panel according to claim 16, wherein the method comprising steps of:

generating a test signal by a test signal generation circuit in the test state for the display panel, and receiving the test signal by a selection circuit, and outputting the test signal; and generating an adjustment signal by an adjustment signal generation circuit in the predetermined state for the display panel, and receiving the adjustment signal by the selection circuit, and outputting the adjustment signal.

18. The method for testing the display panel according to claim 17, wherein the method comprising steps of:

generating a first control signal and a second control signal by a control circuit;

receiving the first control signal by a first control terminal of a first switch in the test state for the display panel, and opening a first current channel according to the first control signal, and outputting the test signal by the first output terminal of the first switch, and receiving the second control signal by a second control terminal of a second switch, and closing a second current channel according to the second control signal; and receiving the first control signal by the first control terminal in the predetermined state for the display panel, and closing the first current channel according to the first control signal, and receiving the second control signal by the second control terminal, and opening the second current channel according to the second control signal, and outputting the adjustment signal by the second output terminal, wherein the first current channel is positioned between the first input terminal and the first output terminal, and the second current channel is positioned between the second input terminal and the second output terminal.

19. The method for testing the display panel according to claim 17, wherein the adjustment signal comprises:

at least one turning on signal for turning on a thin film transistor switch of the display panel; and at least one reducing signal inputted in the pixel electrodes of the display panel to reduce the afterimage signal in the display panel when the thin film transistor switch is turned on;

the method further comprising steps of:

the turning on signal is inputted to a gate of the thin film transistor switch through a scan line of the display panel by the test circuit, and the reducing signal is inputted to the pixel electrodes through a data line of the display panel and the thin film transistor switch by the test circuit.

20. The method for testing the display panel according to claim 16, wherein the display panel is an active matrix OLED panel, and the method further comprising steps of:

sending an inhibitory signal to the active matrix OLED panel in the predetermined state by the test circuit, and the inhibitory signal is provided to a driving switch circuit to inhibit the offset of the voltage threshold of the driving switch circuit.

* * * * *